United States Patent [19]
Morishita et al.
[11] 4,317,542
[45] Mar. 2, 1982

[54] FUEL INJECTOR

[75] Inventors: Teru Morishita, Shizuoka; Daiki Fukuda, Susono, both of Japan

[73] Assignee: Toyota Jidosha Kogyo Kabushiki Kaisha, Toyota, Japan

[21] Appl. No.: 118,465

[22] Filed: Feb. 4, 1980

[30] Foreign Application Priority Data

Feb. 23, 1979 [JP] Japan ..... 54-19676

[51] Int. Cl.[3] ..... B05B 1/30
[52] U.S. Cl. ..... 239/585; 239/533.2
[58] Field of Search ..... 239/585, 533.11-533.12, 239/468, 469, 430, 471, 494, 496

[56] References Cited

U.S. PATENT DOCUMENTS 3,223,331 12/1965 Baker ..... 239/533.2 X
3,443,760 5/1969 Simmons ..... 239/471 X
4,179,069 12/1979 Knapp et al. ..... 239/585 X

*Primary Examiner*—Robert B. Reeves
*Assistant Examiner*—Gene A. Church
*Attorney, Agent, or Firm*—Oblon, Fisher, Spivak, McClelland & Maier

[57] ABSTRACT

A fuel injector comprising a movable needle actuated by a solenoid for controlling the opening operation of a valve port. A fuel swirl chamber is arranged downstream of the valve port and has a conically shaped circumferential inner wall. The fuel injection port opens into the fuel swirl chamber at the apex thereof. The fuel swirl chamber has a fuel inlet port connected to the valve port via a fuel passage. The fuel inlet port is tangentially connected to the circumferential inner wall of the fuel swirl chamber.

11 Claims, 5 Drawing Figures

FUEL INJECTOR

DESCRIPTION OF THE INVENTION

The present invention relates to a fuel injector, and more particularly relates to a constant pressure type fuel injector suited for use in an internal combustion engine.

In an internal combustion engine in which fuel is injected into the combustion chamber or the intake manifold, it has been proven that the atomization and vaporization of fuel is promoted by causing the fuel injected from the fuel injector to swirl. As a fuel injector capable of causing the fuel injected from the fuel injector to swirl, various swirl type fuel injectors have been known. A fuel injector of this type normally has a movable needle arranged in the housing thereof and actuated by a solenoid. In this type of injector, a fuel injection port is formed on the tip of the housing, and a valve port, cooperating with the tip of the movable needle for controlling the injecting operation of fuel, is formed in the fuel passage located between the fuel injection port and the fuel feed port formed on the rear end of the housing. In addition, in this fuel injector, the fuel swirl chamber is formed immediately upstream of the valve port or in the valve port which is formed between the tip of the movable needle and the valve seat formed on the housing. In the case wherein the fuel swirl chamber is formed immediately upstream of the valve port as mentioned above, a swirl motion of fuel is created in the fuel swirl chamber by the fuel which flows into the fuel swirl chamber tangentially to the circumferential inner wall of the fuel swirl chamber after the movable needle opens the valve port. Then, the fuel within the fuel swirl chamber, while swirling, passes through the valve port and, then, is injected, while swirling, from the fuel injection port. As a result, the fuel injected from the fuel injector is caused to swirl. However, in the case wherein the fuel swirl chamber is formed immediately upstream of the valve port, it is impossible to create a swirl motion of the fuel within the fuel swirl chamber immediately after the movable needle opens the valve port. Therefore, at this time, since the fuel within the fuel swirl chamber is injected from the fuel injection port via the valve port without swirling, a problem occurs in that it is impossible to fully promote the atomization and vaporization of the fuel immediately after the movable needle opens the valve port.

On the other hand, in the case wherein the fuel swirl chamber is formed in the valve port which is formed between the tip of the movable needle and the valve seat formed on the housing as mentioned above, the swirl motion of fuel is created in the valve port by the fuel flowing into the valve port when the movable needle moves upwards and opens the valve port. Then, since the fuel within the valve port is injected, while swirling, from the fuel injection port, the fuel injected from the fuel injector is caused to swirl. However, in the case wherein the fuel swirl chamber is formed in the valve port, since the area of the valve port is increased as the movable needle moves upwards, the strength of the swirl motion created in the valve port is changed in accordance with a change in the position of the movable needle and, as a result, a problem occurs in that it is impossible to create a swirl motion having a constant strength throughout the entire time period during which the injecting operation is carried out.

An object of the present invention is to provide a fuel injector capable of causing the fuel injected from the fuel injector to swirl at a constant strength throughout the entire time period during which the injecting operation is carried out.

According to the present invention, there is provided a fuel injector comprising: a housing; a fuel feed port arranged on one end of said housing; a fuel injection port arranged on the other end of said housing; a fuel passage formed in said housing and interconnecting said fuel feed port to said fuel injection port; a valve seat formed on an inner wall of said fuel passage; a needle movable in said housing and having a tip which cooperates with said valve seat for defining a valve port therebetween, said valve port dividing said fuel passage into a first passage section located between said fuel feed port and said valve port and a second passage section located between said fuel injection port and said valve port, said first passage section being filled with fuel the pressure of which is maintained constant, and; means for actuating said needle to open said normally closed valve port and allow the fuel to be injected from said fuel injection port, wherein the improvement comprises a fuel swirl chamber arranged in said housing between said second passage section and said fuel injection port and having a circumferential inner wall which extends around an axis of said fuel swirl chamber, said second passage section having one end connected to said valve port and the other end which opens into said fuel swirl chamber and being is tangentially connected to the circumferential inner wall of said fuel swirl chamber, said fuel injection port extending along the axis of said fuel swirl chamber and opening into said fuel swirl chamber.

The present invention may be more fully understood from the description of a preferred embodiment of the invention set forth below, together with the accompanying drawings.

DESCRIPTION OF A PREFERRED EMBODIMENT

Figure 1:
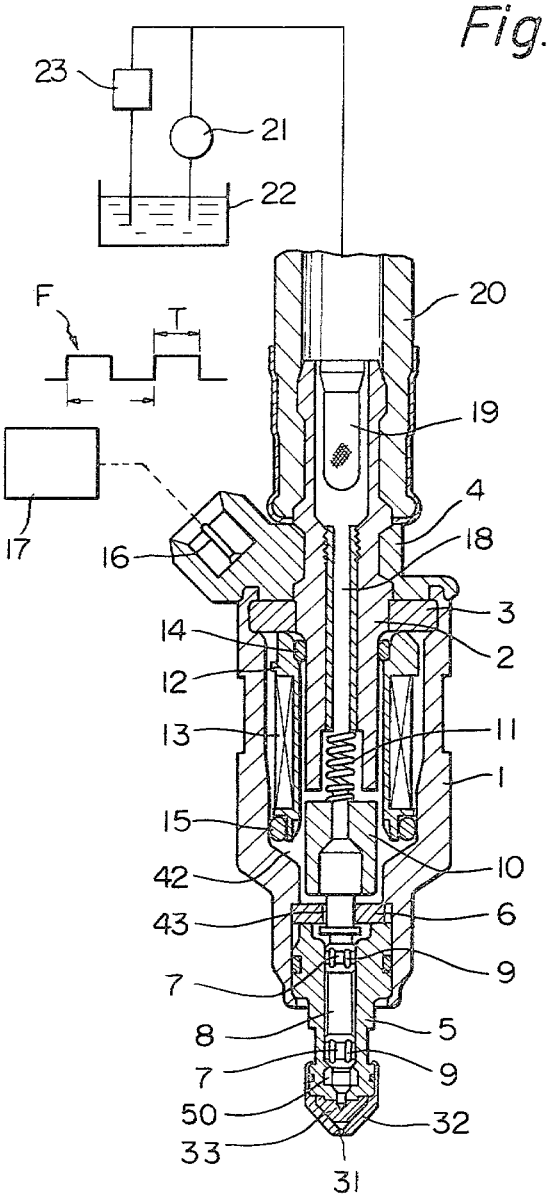
FIG. 1 is a cross-sectional side view of a fuel injector according to the present invention.
Figure 2:
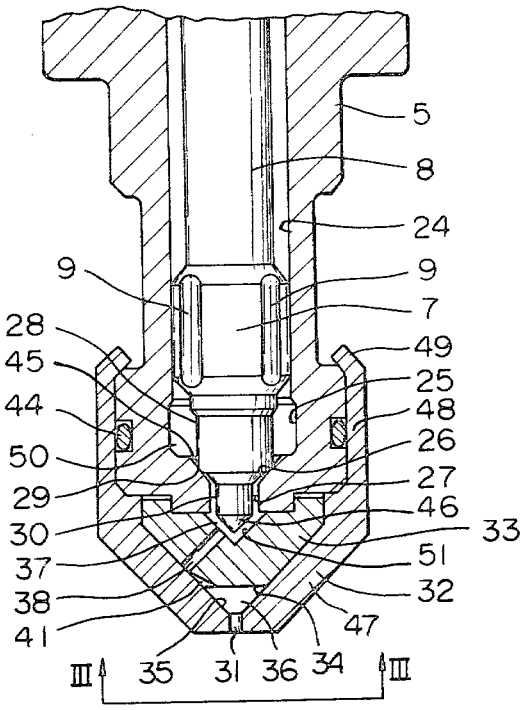
FIG. 2 is an enlarged cross-sectional view of a part of the fuel injector illustrated in FIG. 1.

Referring to FIGS. 1 and 2, 1 designates a housing of a fuel injector, 2 a fuel feed pipe inserted into the housing 1, 3 an annular and plate for fixing the fuel feed pipe 2 onto the housing 1, 4 a connector mounting member fixed onto the housing 1 at a position outside of the annular end plate 3 and 5 a needle holder fixed onto the lower end of the housing 1 via a spacer 6. A movable needle 8 having a pair of expanding portions 7 is inserted into the needle holder 5 so that the movable needle 8 is able to slide in the needle holder 5 in the axial direction of the housing 1. A plurality of grooves 9 is formed on the outer circumferential walls of the expanding portions 7. A movable core 10 is fixed onto the upper end of the movable needle 8, and a compression spring 11 is inserted between the movable core 10 and the lower end of the fuel feed pipe 2. A solenoid 13 held by a solenoid holder 12 is inserted into an annular space formed between the housing 1 and the fuel feed pipe 2, and the solenoid holder 12 is inserted between the housing 1 and the fuel feed pipe 2 via a pair of 0 rings 14, 15. The solenoid 13 is connected to a connector 16 mounted on the connector mounting member 4, and the connector 16 is connected to an electronic control circuit 17 for energizing the solenoid 13. As illustrated in FIG. 1, a fuel passage 18 extending in the axial direction of the housing 1 is formed in the fuel feed pipe 2, and a filter 19 is inserted into the upper end of the fuel passage 18. A fuel conduit 20 is fitted into the upper end of the fuel feed pipe 2 and connected to a fuel tank 22 via a fuel feed pump 21. The fuel feed pump 21 is equipped with a relief valve 23 which serves to maintain the delivery pressure of the fuel feed pump 21 constant and, therefore, fuel is always fed into the fuel passage 18 at a constant pressure via the fuel conduit 20.

Figure 3:
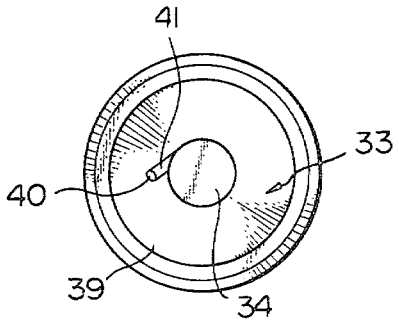
FIG. 3 is a bottom view taken along line III—III in FIG. 2, and illustrates the case wherein the spacer holder is removed.

As illustrated in FIG. 2, a needle insert hole 24 is formed in the needle holder 5, and the needle 8 moves up and down in the needle insert hole 24. The lower end portion of the needle insert hole 24 has an enlarged cylindrical inner wall portion 25, a conically shaped valve seat 26 and a cylindrical inner wall portion 27 having a diameter which is smaller than that of the enlarged cylindrical inner wall portion 25. On the other hand, the lower end portion of the movable needle 8 forms thereon an increased diameter portion 28, a reduced diameter portion 30 and a conically shaped valve seat 29 arranged to face the conically shaped valve seat 26. As it is apparent from FIG. 2, the cylindrical inner wall portion 27 has a uniform diameter over the entire length thereof, and the reduced diameter portion 30 also has a uniform diameter over the entire length thereof, which diameter is slightly smaller than that of the cylindrical inner wall portion 27. Consequently, when the movable needle 8 is caused to move upwards due to the attracting force of the solenoid 13 (FIG. 1) as hereinafter described, an annular clearance having a fixed cross-sectional area is formed between the cylindrical inner wall portion 27 and the reduced diameter portion 30 independently of the position of the movable needle 8. A spacer holder 32 forming a fuel injection port 31 thereon is fitted onto the lower end of the needle holder 5. The spacer holder 32 has a conically shaped portion 47 at the lower portion thereof and a thin, hollow cylindrical portion 48 at the upper portion thereof. The spacer holder 32 is fixed onto the needle holder 5 in such a way that an upper end 49 of the hollow cylindrical portion 48 is bent inwardly. An 0 ring 44 is inserted between the needle holder 5 and the spacer holder 32 for preventing the leakage of fuel, and a spacer 33 shaped substantially in the form of a frustum of a cone is arranged on the lower end face of the needle holder 5 and held by the conically shaped portion 47 of the spacer holder 32. A conically shaped fuel swirl chamber 36 is formed between a flat top face 34 of the spacer 33 and a conical inner wall 35 of the spacer holder 32, and the fuel injection port 31 is formed on the apex of the fuel swirl chamber 36. A conical projection 46 is formed in one piece on the lower end of the reduced diameter portion 30 of the needle 8 so that a fuel passage portion 37 having an extremely small volume is formed between the conical projection 46 and an inner wall 51 of the spacer 33, whose wall 51 has a complementary shape relative to the outer wall of the conical projection 46. A fuel passage portion 38 extending from the fuel passage portion 37 towards the conical outer circumferential wall of the spacer 33 is formed in the spacer 33. On the other hand, as illustrated in FIGS. 2 and 3, a fuel passage portion 41 extending from an open end 40 of the fuel passage portion 38 into the fuel swirl chamber 36 is formed on a conical outer circumferential wall 39 of the spacer 33. The opening of the fuel passage portion 41 is tangentially connected to the conical inner wall 35 of the spacer holder 32, which defines the fuel swirl chamber 36 therein.

As mentioned previously with reference to FIGS. 1 and 2, the fuel, which is maintained at a constant pressure, is fed into the fuel passage 18 formed in the fuel feed pipe 2 from the fuel feed pump 21. Then, the fuel is fed into an annular space 50 formed between the enlarged cylindrical inner wall portion 25 and the increased diameter portion 28 via a space 42 formed between the movable core 10 and the housing 1, via a groove 43 formed in the spacer 6 and via the grooves 9 formed on the expanding portions 7 of the movable needle 8. Consequently, the annular space 50 is filled with fuel which is maintained at a constant pressure.

The electronic control circuit 17 produces pulses illustrated by arrow F in FIG. 1. In FIG. 1, the length of time during which the needle valve 8 is open is indicated by T, and the time interval of the generation of the pulses is indicated by t. Consequently, the frequency f of the opening operation of the needle valve 8 is equal to 1/t. When the pulse F is fed into the solenoid 13, the solenoid 13 is energized over the time period T during which the pulse F generates. When the solenoid 13 is energized, the movable core 10 is attracted by the solenoid 13 and moves upwards and, accordingly, the movable needle 8 moves upwards. When the movable needle 8 moves upwards, a valve port 45, formed between the stationary valve seat 26 of the needle holder 5 and the valve seat 29 of the movable needle 8, opens. At this time, as mentioned previously, the cross-sectional area of the annular clearance formed between the cylindrical inner wall portion 27 and the reduced diameter portion 30 is maintained constant, independently of the position of the movable needle 8. When the valve port 45 opens, the fuel within the annular space 50 flows into the conical shell shaped fuel passage portion 37 via the valve port 45. As mentioned previously, the pressure of the fuel within the annular space 50 is maintained constant. Consequently, the fuel passage portion 37 is filled with fuel of a constant pressure only during the time period T, wherein the movable core 10 is attracted by the solenoid 13 and moves upwards. Then, the fuel flowing into the fuel passage portion 37 flows into the fuel swirl chamber 36 via the fuel passage portions 38, 41. At this time, the fuel flowing into the fuel swirl chamber 36 from the fuel passage portion 41 swirls along the conical inner wall 35 of the spacer holder 32 and, then, is injected, while swirling, from the fuel injection hole 31.

As mentioned above, the fuel flowing into the fuel swirl chamber 36 from the fuel passage portion 41 swirls along the conical inner wall 35 of the spacer holder 32 and, then, is injected from the fuel injection port 31. Consequently, the fuel swirl chamber 36 is not filled with fuel. Therefore, after the movable needle 8 closes the valve port 45 to stop the fuel injecting operation, fuel does not remain within the fuel swirl chamber 36, and an extremely small amount of the fuel remains within the fuel passage portions 37, 38 and 41. Since the conical projection 46 is formed on the lower end of the movable needle 8, the area of the fuel passage portion 37 is extremely small, and therefore, the amount of the residual fuel remaining within the fuel passage portions 37, 38 and 41 is extremely small. Since the amount of this residual fuel remaining within the fuel passage portions 37, 38 and 41 is extremely small, as compared with the amount of the fuel injected from the fuel injector, and since the residual fuel remaining within the fuel passage portions 37, 38 and 41 is pushed into the fuel swirl chamber 36 and, then, is injected, while swirling, from the fuel injection port 31 when the movable needle 8 opens the valve port 45, the fuel injected from the fuel injection port 31 is caused to swirl immediately after the injecting operation is started. In addition, the fuel injection pressure of the fuel injector becomes equal to a fixed value at the same time the injecting operation is started.

In a constant pressure type fuel injector as in the present invention, if the sizes of the fuel swirl chamber 36, the fuel injection port 31 and the fuel passage portion 41 are determined, the capability to atomize fuel depends on the level of the fuel injection pressure of the fuel injector. Such a dependency has been known, for example, as disclosed in the technical report in the Transactions of the Japan Society of Mechanical Engineers, volume 19, No 80, 1953, entitled "The Atomization of Fuel in a Fuel Injector", Kiyoshi Kobayashi.

Figure 4:
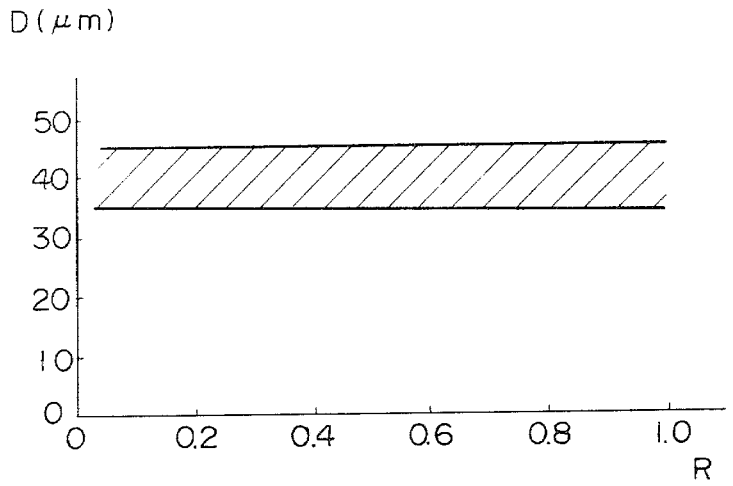
FIG. 4 is a graph showing the mean diameter of the fuel droplets injected from a fuel injector according to the present invention.

FIG. 4 illustrates the results of experiments conducted by the inventor. In FIG. 4, the ordinate indicates the mean diameter D(μm) of fuel droplets, which is indicated in the form of a Sauter mean diameter, and the abscissa indicates the ratio R of an amount of the fuel injected from the fuel injector to a maximum amount of the fuel injected from the fuel injector. The experiments were conducted over a wide range in the amount of fuel injected from the fuel injector by changing the time period t/T, during which the injecting operation was carried out, in the range of 28.6 to 1.0, and by changing the frequency f(=1/t) in the range 7 Hz to 50 Hz. From FIG. 4, it will be understood that the mean diameter D of the fuel droplets injected from the fuel injector according to the present invention is an extremely small size of about 40 μm, independently of an amount of the fuel injected from the fuel injector, as illustrated by the hatching in FIG. 4, and thus, a good atomization of fuel can be obtained.

Figure 5:
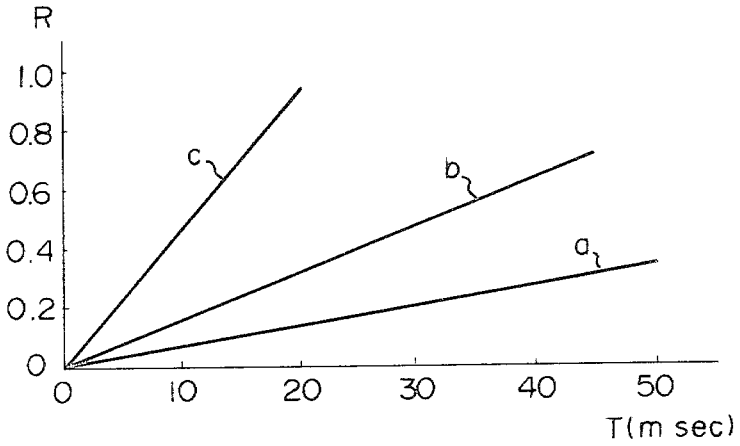
FIG. 5 is a graph showing the relationship between the amount of fuel injected from a fuel injector according to the present invention and the time period during which the injecting operation is carried out.

In the fuel injector according to the present invention, the effective flow area of the valve port 45, which is created when the movable needle 8 fully opens the valve port 45, is larger than the effective flow area of the fuel passage located between the fuel injection port 31 and the annular clearance which is formed between the cylindrical inner wall portion 27 and the reduced diameter portion 30. Therefore, since the fuel injection pressure of the fuel injector is maintained constant, if the size of the above-mentioned fuel passage, that is, the sizes of the above-mentioned annular clearance, the fuel passage portions 37, 38, 41, the fuel swirl chamber 36 and the fuel injection port 31, are determined, the amount of the fuel injected from the fuel injector per a unit time is determined. Among the above-mentioned annular clearance, the fuel passage portions 37, 38, 41, the fuel swirl chamber 36 and the fuel injection port 31, the fuel injection port 31 has a minimum size and, therefore, the size of the fuel injection port 31 has the greatest influence on the amount of the fuel injected from the fuel injector. FIG. 5 illustrates the relationship between the amount of the fuel injected from the fuel injector and the time period T during which the injecting operation is carried out. In FIG. 5, the ordinate indicates the ratio R of an amount of the fuel injected from the fuel injector to a maximum amount of the fuel injected from the fuel injector, and the abscissa indicates the time period T (msec) during which the injecting operation is carried out. In addition, in FIG. 5, the straight lines a, b and c illustrate the case wherein the frequency f is equal to 7 Hz, 16.7 Hz and 50 Hz, respectively. From FIG. 5, it will be understood that, if the frequency f is maintained constant, the amount of the fuel injected from the fuel injector is directly proportional to the time period T.

According to the present invention, a good atomization of fuel can be always obtained independently of the amount of the fuel injected from the fuel injector. In addition, the amount of the fuel injected from the fuel injector is exactly proportional to the time period during which the injecting operation is carried out. Consequently, the fuel injector according to the present invention is suited for use in an internal combustion engine.

While the invention has been described by reference to a specific embodiment, chosen for purposes of illustration, it should be apparent that numerous modifications could be made thereto by those skilled in the art without departing from the spirit and scope of the invention.

What is claimed is:

1. A fuel injector comprising: a housing, a fuel feed port arranged on one end of said housing; a fuel injection port arranged on the other end of said housing; a fuel passage formed in said housing and interconnecting said fuel feed port to said fuel injection port; a valve seat formed on an inner wall of said fuel passage; a needle movable in said housing and having a tip which cooperates with said valve port dividing said fuel passage into a first passage section located between said fuel feed port and said valve port and a second passage section located between said fuel injection port and said valve port, said first passage section being filled with fuel the pressure of which is maintained constant, and means for actuating said needle to open said normally closed valve port and allow the fuel to be injected from said fuel injection port, wherein the improvement comprises a fuel swirl chamber arranged in said housing between said second passage section and said fuel injection port and having a circumferential inner wall which extends around an axis of said fuel swirl chamber, said second passage section having one end connected to said valve port and the other end which opens into said fuel swirl chamber and being tangentially connected to the circumferential inner wall of said fuel swirl chamber, said fuel injection port extending along the axis of said fuel swirl chamber and opening into said fuel swirl chamber, wherein the effective flow of said valve port created when said needle fully opens said valve port is greater than that of said second passage section, and wherein said second passage section includes a passage portion located immediately downstream of said valve port and formed between an inner wall of said passage section and said needle, said passage portion having a cross-sectional area which is maintained constant independently of the position of said needle when said needle moves away from said valve seat.

2. A fuel injector as claimed in claim 1, wherein said effective flow area of said valve port is greater than the effective flow area at any points within said second passage section.

3. A fuel injector as claimed in claim 1, wherein said fuel injection port has a minimum effective flow area.

4. A fuel injector as claimed in claim 1, wherein the circumferential inner wall of said fuel swirl chamber has a conical shape.

5. A fuel injector as claimed in claim 4, wherein said fuel swirl chamber has an apex at which said fuel injection port opens into said fuel swirl chamber.

6. A fuel injector as claimed in claim 1, wherein said needle has a reduced diameter portion located immediately downstream of said valve port, said passage portion being an annular clearance formed between said reduced diameter portion and the inner wall of said passage portion.

7. A fuel injector as claimed in claim 6, wherein said needle has a conical projection formed in one piece on said reduced diameter portion, said second passage section including a conical shell shaped clearance which is located immediately downstream of said annular clearance and is formed around said conical projection.

8. A fuel injector as claimed in claim 1, wherein said fuel injector further comprises a spacer arranged at said other end of said housing, and a spacer holder mounted on said other end of said housing and enclosing holding said spacer, said spacer and said spacer holder forming said fuel swirl chamber therebetween.

9. A fuel injector as claimed in claim 8, wherein said spacer is shaped substantially in the form of a frustum of a cone and has a conically shaped outer circumferential wall, said spacer holder having a conically shaped inner wall which is in sealing contact with the outer circumferential wall of said spacer and defines said fuel swirl chamber which has a conical shape.

10. A fuel injector as claimed in claim 9, wherein said second passage section includes a passage portion formed in said spacer and comprising a first portion which extends within said spacer and has an open end formed on the conically shaped outer circumferential wall of said spacer, and a second passage which is formed in the conically shaped outer circumferential wall of said spacer and extends from said open end into said fuel swirl chamber.

11. A fuel injector as claimed in claim 9, wherein said spacer holder further comprises a thin, hollow cylindrical portion fitted onto said housing and having an end portion which is inwardly bent for fixing said spacer holder onto said housing, a sealing member being inserted between said housing and said hollow cylindrical portion.

* * * * *